United States Patent [19]

Weisgerber

[11] Patent Number: 4,794,714

[45] Date of Patent: Jan. 3, 1989

[54] FRAME ASSEMBLY FOR A DISPLAY ITEM

[76] Inventor: Robert G. Weisgerber, R.D. #6, Box 2732, Mount Pleasant, Pa. 15666

[21] Appl. No.: 709,384

[22] Filed: Mar. 7, 1985

[51] Int. Cl.[4] ..... G09F 1/12

[52] U.S. Cl. ..... 40/152; 40/158.1

[58] Field of Search ..... 40/152, 10 R, 156, 152.1, 40/154, 155, 158 R, 158 B, 611

[56] References Cited

U.S. PATENT DOCUMENTS

| | | | |
|---|---|---|---|
| 132,314 | 10/1872 | Moulton | 40/152 |
| 190,068 | 4/1877 | Odenbaugh | 40/152 |
| 842,645 | 1/1907 | Gallagher | 40/152 |
| 845,570 | 2/1907 | Paul | 40/152 |
| 1,842,473 | 1/1932 | Glassner | 40/152 |
| 2,218,409 | 10/1940 | Smalls | 40/152 |
| 2,346,283 | 4/1944 | Weiss | 40/152 |
| 2,782,541 | 2/1957 | Spertus | 40/152 |
| 3,070,914 | 1/1963 | Henderson et al. | 40/152 |
| 3,283,431 | 11/1966 | Pearlman | 40/152 |
| 3,408,759 | 11/1968 | Rotheraine et al. | 40/152 |
| 3,507,066 | 4/1970 | Widigs | 40/152 |
| 3,579,886 | 5/1971 | Hughes | 40/152 |
| 3,611,604 | 10/1971 | Saltzman | 40/152 |
| 3,782,015 | 1/1974 | Esry | 40/152 |
| 3,813,799 | 6/1974 | Caravello | 40/152 |
| 4,115,938 | 9/1978 | Belmuth et al. | 40/152 |

FOREIGN PATENT DOCUMENTS

| | | | |
|---|---|---|---|
| 1157644 | 11/1983 | Canada | 40/152 |
| 63005 | 11/1944 | Denmark | 40/152 |
| 373043 | 4/1907 | France | 40/152 |
| 734816 | 8/1932 | France | 40/152 |
| 2308336 | 11/1976 | France | 40/152 |
| 2114884 | 9/1983 | United Kingdom | 40/152 |

*Primary Examiner*—Gene Mancene
*Assistant Examiner*—J. Hakomaki

[57] ABSTRACT

A frame structure has one or several windows for receiving and supporting a frame unit containing a display item. The frame unit consists of a frame member having a window corresponding to that of the frame structure for viewing the display item, which item is positioned behind a plate glass and sandwiched between several other layers of material, all of which are secured between the frame member and back frame plate. Around the periphery of each window in the frame structure is an inward lip having surfaces running toward and parallel to the layered material, which lip encircles an inward leg of the frame member for holding the frame unit in position in the frame structure. In a cross sectional view, the frame member is joined to the frame plate to form a "U" configuration for receiving the peripheral edges of the layered material and the lip of the frame structure is in the form of an "L" and extends toward the place glass.

2 Claims, 3 Drawing Sheets

FRAME ASSEMBLY FOR A DISPLAY ITEM

BACKGROUND OF THE INVENTION

The present invention relates to a frame assembly for displaying one or more items such as a picture or photograph. More particularly, the invention concerns a frame structure constructed to support and carry one or separately support and carry a plurality of frame units, each containing and displaying an item.

Conventional frames are generally structured to display only one item and consist of a member holding a transparent layer, a display item, one or more layers of material, and a backing which is slideable within the frame for retaining the display item and layers of material in the frame.

Still other frame structures carry a display item which are permanently sealed therein. In order for the item to be replaced, the seal has to be broken and reestablished after the item is replaced.

In these designs for present day frames, in addition to breaking the seal, in order to replace a display item the several layers of material are removed and replaced either separately or several layers at a time.

It is an object of the present invention to provide a frame assembly and an integral frame unit carrying a display item, which frame unit is insertable and removable from the frame assembly as a unit without disturbing the sealing condition.

A further objection of the present invention is to provide a frame assembly comprising a frame structure having lip means for encircling a frame unit carrying a display item in a manner the frame unit has little or no space for movement within the frame structure.

Still a further object of the present invention is to provide a frame unit for displaying an item and comprising an outer frame and plate joined together and which in cross section forms a "U" for receiving a sheet of transparent material behind which the display item is positioned and several other layers of material for mounting and sealing the display item in the frame unit.

A still further object of the present invention is to provide a frame assembly having a frame structure for carrying one or several such frame units.

More particularly, it is an object of the present invention to provide a frame assembly for displaying an item, such as a picture, photograph or the like, comprising: a frame structure having window means for displaying said item, and at least one integral frame unit containing said displayed item and having a window cooperating with said window means of said frame structure for said displaying of said item, and further constructed and arranged in a manner to be received by and carried as a unit by said frame structure, said frame unit comprising ledge means arranged substantially around an inner peripheral surface encircling said display item.

These and other objects and advantages of the present invention will be better appreciated and understood when the following description of several embodiments is read along with the accompanying drawings of which:

DETAILED DESCRIPTION OF THE DRAWINGS

Figure 1:
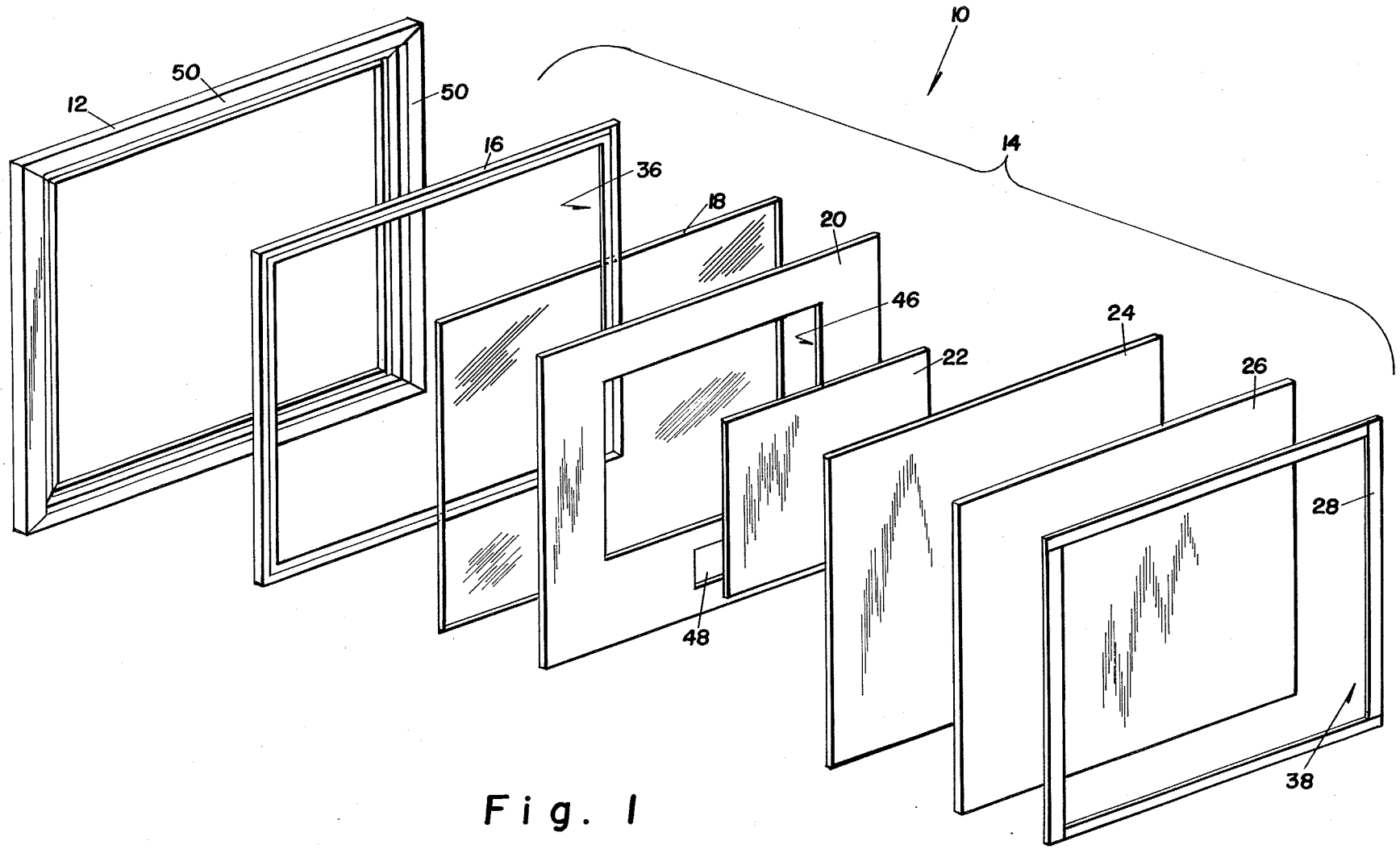
FIG. 1 is a rear, elevational view showing the components of a first embodiment of the present invention in disassembled form.

Referring first to FIG. 1, there is shown a frame assembly 10 consisting of a rectangular wooden frame structure 12 for receiving and supporting a corresponding rectangular frame unit 14, which, in turn consists of metal frame 16, plate glass 18, front mat board 20, print or photograph 22, backing mat board 24, rear foam board 26, and rear metal plate 28, which when assembled provide a fully sealed environment for print or photo 22. As indicated by the bracket, these components of frame unit 14 are joined together as shown in FIGS. 2A–2D, and outer metal frame 16 is secured to rear plate 28 by several screws 30 positioned around the outer periphery of frame unit 14 (one of which screw 30 is shown at the right hand corner of FIG. 2C).

FIGS. 3A–3D illustrate frame unit 14 in outer wooden frame structure 12, wherein frame unit 14 is mounted therein by several pins 32 in channel 34 inserted diagonally across the corners of frame unit 14 and extending into wooden frame structure 12.

Again referring to FIG. 1, metal frame 16 and rear metal plate 28 each have an opening 36, 38 respectively and wherein opening 36 in frame 16 allows viewing of display item 22. As FIGS. 2D and 3D show, frame 16 is in the form of an "L" which cooperates with plate 28 to form a "U" configuration. The body portion 40 of frame 16 adds rigidity to frame unit 14. As also shown in FIGS. 2D and 3D, the dimension of the area of the remaining components 18–26 of frame unit 14 are less than that of frame 16 and place 28 so as to fit between the two legs 42, 44 of the "U" configuration. Frame 16 is molded into an integral, rectangular piece as shown in FIGS. 1 and 2A, and rear plate 28 is formed by joining several strips together by welding to form a rectangular frame, as particularly shown in FIGS. 1 and 2B.

Figure 2A:
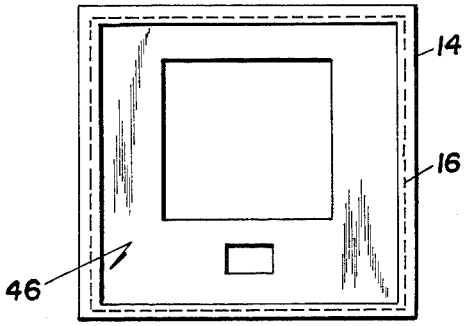
FIGS. 2A–2B are front and rear elevational views of the components of a first embodiment of the present invention in assembled form.
Figure 2B:
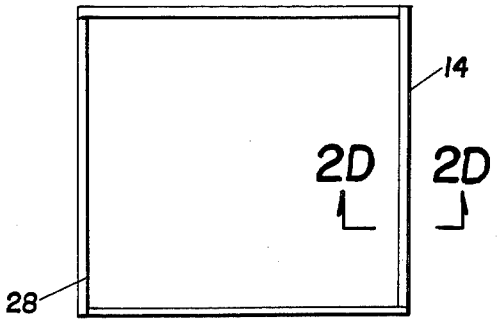
Figure 2C:
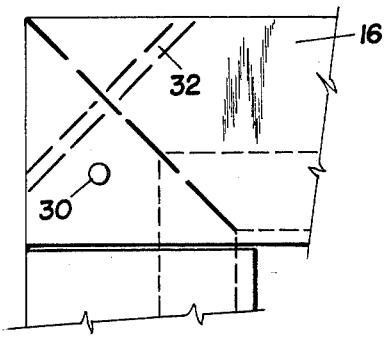
FIG. 2C is an enlarged, detailed view of the upper left hand corner of FIG. 2A.
Figure 2D:
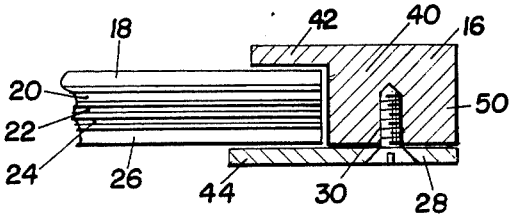
FIG. 2D is an enlarged, detailed cross section view taken along lines 2D—2D of FIG. 2B.
Figure 3A:
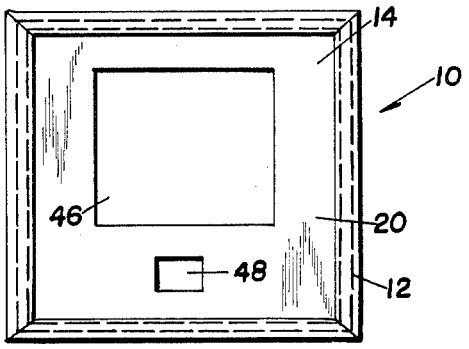
FIGS. 3A and 3B are front and rear elevational views of the components of a first embodiment in assembled form.
Figure 3B:
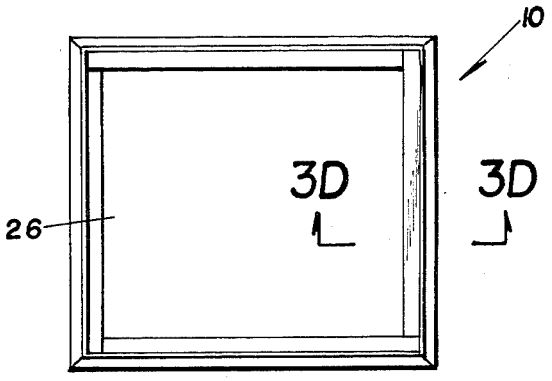

FIGS. 1, 2A and 3A show front mat board 20 as having a large window or opening 46 for bordering around print or photo 22, and a smaller window or opening 48 for bordering around a title or description of display item 22 which may be mounted on rear mat board 26 behind display item 22 for identifying purposes. Both the display item 22 and designation in window 48 are to be viewed through plate glass 18 when the components of frame unit 14 are assembled.

Frame structure is made of a quality wood, such as oak or maple, and is formed into a rectangle by strips 50 which are beveled at the corners to fit together, and as FIGS. 2D and 3D show, each strip 50 has a cut out section 52 in the back of frame structure 12 in the shape of a "U" with a lip portion 52 shorter and thinner than body portion 54 of strip 50 forming structure 12. This "U" forms a slot for receiving and encircling frame unit 14 and as shown, lip portion 52 is adjacent leg 42 of frame unit 14 for limiting movement of frame unit 14 to the left in FIG. 3D, a body portion 54 of frame structure 12 is adjacent body portion 40 of frame unit 14 for limiting movement of frame unit 14 to the right of FIG. 3D.

Figure 3C:
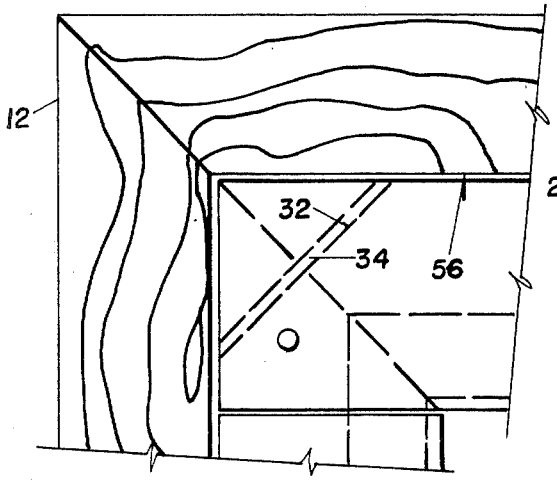
FIG. 3C is an enlarged detailed view of the upper left hand corner of FIG. 3A.
Figure 3D:
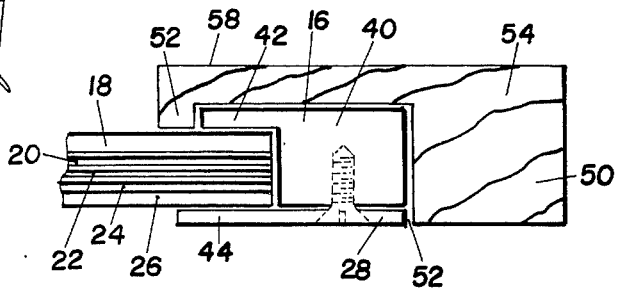
FIG. 3D is an enlarged, detailed cross sectional view taken along lines 3D—3D of FIG. 3B.

For mounting frame unit 14 in frame structure 12, frame unit 14 is placed directly into slot 52 through the back of frame structure 12 (FIG. 1), and is held securely therein by the aforesaid diagonal pins 32 jutting into the inner peripheral portion 56 of adjacent strips 50 forming frame structure 12 (FIG. 3C). An alternative for securing frame unit 14 in frame structure 12 is to attach through suitable means a rectangular plate (not shown) against the back of frame structure 12 and frame unit 14.

When viewed from the front, the outer surfaces of frame structure 12 border around and frame said display item carried by frame unit 14. Outer surface 58 extends toward and inwardly along lip 52 of frame structure 12 adjacent glass plate 18 and leg 42 of frame unit 14 respectively to give an effect that glass plate 18 is placed within wooden frame structure 12 in a conventional fashion.

The insertion or assembly of frame unit 14 in frame structure 12 strengthens frame assembly 10 in that the surface edges of slot 52 in frame structure 12 interact with the outer surfaces of frame unit 14 in such a manner that forces are exerted on opposing surfaces at the various points of contact therebetween.

Figure 5:
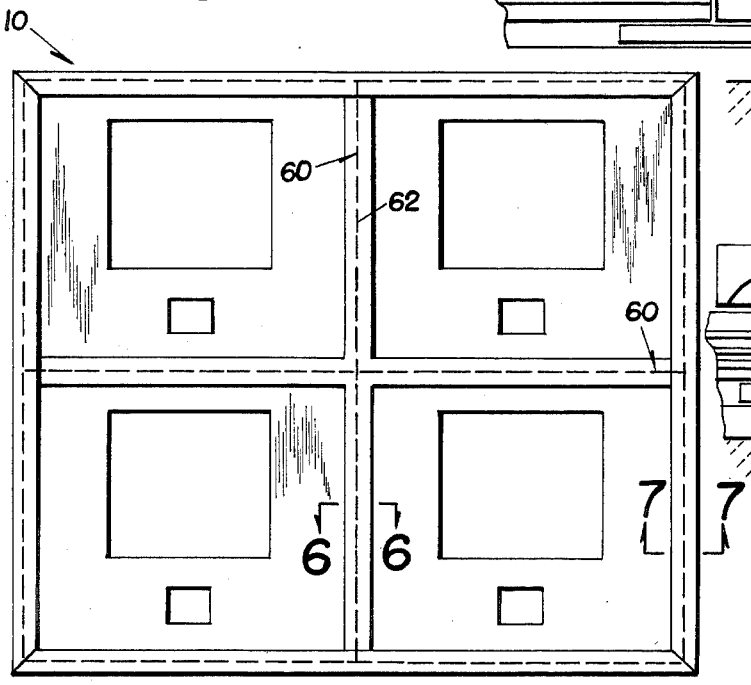
FIG. 5 is a front, elevational view of a third embodiment of the present invention in assembled form.
Figure 4:
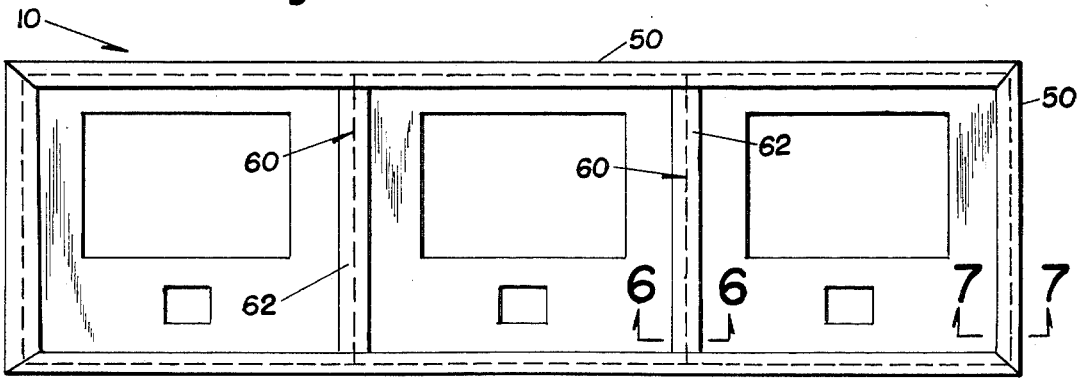
FIG. 4 is a front, elevational view of a second embodiment of the present invention in assembled form.

FIGS. 4 and 5 illustrate two different designs for frame structure 12 of frame assembly 10 for carrying three and four frame units 14, respectively. Divider means 60 consisting of strips 62 are mounted in frame structure 12 to separate frame structure 12 into equal size windows or openings for receiving equal size frame units 14, which are arranged side by side as shown in FIG. 4 and in a square formation as shown in FIG. 5.

In FIG. 4, strips 62 are attached to upper and lower strips 50 of frame structure 12, and in FIG. 5, strips 62 are attached to the four sides of frame structure 12.

Figure 6:
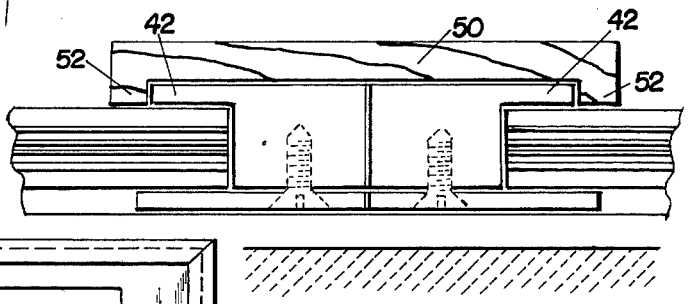
FIG. 6 is an enlarged, detailed cross sectional view taken along lines 6—6 of FIGS. 4 and 5.
Figure 7:
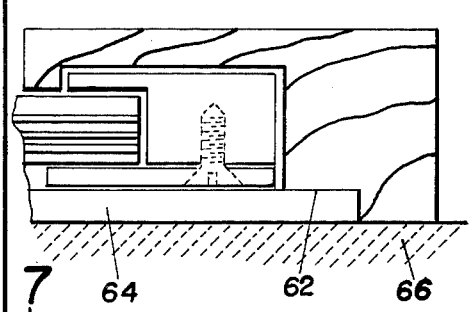
FIG. 7 is an enlarged, detailed cross sectional view taken along lines 7—7 of FIGS. 4 and 5.

FIG. 6 illustrates divider strips 62 for retaining two adjacent frame units 14 of FIGS. 4 and 5 along their inward opposing surfaces thereof, and FIG. 7 illustrates the construction of frame structure 12 for retaining each frame unit 14 of FIGS. 4 and 5 along the extreme outer peripheral surfaces of assembled frame units 14.

As particularly shown in FIG. 6, each strip 50 has two lip portions 52 for encircling ledge 42 of each adjacent frame unit 14. In FIG. 7, body portion 54 of frame structure 12 has a second cut out section 62 having ledges for receiving a back plate 64 (FIGS. 6 and 7) extending across the back of frame units 14 for their retainment in frame structure 12, and this back plate 64 is attached to the back of frame structure 12 through suitable fastening means (not shown).

Frame structure 12 is supportable on or against any suitable surface area 66 as shown in FIGS. 6 and 7.

Each frame unit 14 is a permanent assembly for the storage of a valuable work of art in an acid free matting system under glass, which unit or units 14 may be stored separately and individually from frame structure 12. Each frame unit 14 is easily interchangeable and replaceable in frame structure 12. In the preceding three embodiments, frame units 14 are inserted in the back of and held in frame structure 12 by attaching mounting plate 64. However, it is also possible to first attach mounting plate 64 to the back of frame structure 12 and provide an opening (not shown) at the top of frame structure 12 for inserting frame units 14 down into frame structure 12.

The frame 16 and plate 28 of frame unit 14 is said to be metal, but it is to be understood that the material may be plastic, which may also be said for frame structure 12. In addition, glass plate can be one of several transparent materials such as plastic.

According to the patent statutes, I have explained the principle and operation of my invention and have described and illustrated what I believe to be the best embodiments thereof.

I claim:

1. A frame assembly for displaying an item, such as a picture, photograph or the like, comprising:

a frame structure having window means for displacing said item, and at least one integral frame unit containing said displayed item and having a window cooperating with said window means on said frame structure for said displaying of said item, and further constructed and arranged in a manner to be received by and carried as a unit by said frame structure, said frame unit comprising ledge means arranged substantially around an inner peripheral surface encircling said displayed item, wherein said frame unit comprises several layers of material including a relatively flat transparent layer protecting said displayed item and having another surface area adjacent said ledge means of said frame unit, said frame structure comprising lip means constructed and arranged in a manner to substantially encase said ledge means of said frame unit and to limit the movement of said frame unit when inserted into and carried by said frame structure, wherein said lip means of said frame structure forms an "L" configuration with surfaces running inwardly toward and parallel to said surface of said transparent layer and said ledge means of said frame unit.

2. A frame assembly according to claim 1, wherein said lip means of said frame structure are located around an outermost periphery thereof, and wherein said frame structure further consists of divider means separating said window means into a plurality of windows, and having lip means, said lip means of said divider means cooperating with those of said outermost periphery of said frame structure for said encasing of said ledge means of said frame unit thereby supporting and carrying a plurality of said frame units corresponding to said plurality of windows.

* * * * *